US005206634A

United States Patent [19]

Matsumoto et al.

[11] Patent Number: 5,206,634

[45] Date of Patent: Apr. 27, 1993

[54] LIQUID CRYSTAL DISPLAY APPARATUS

[75] Inventors: Toshio Matsumoto; Kyoushi Tanaka; Kenichi Kato, all of Tenri, Japan

[73] Assignee: Sharp Kabushiki Kaisha, Osaka, Japan

[21] Appl. No.: 771,454

[22] Filed: Sep. 30, 1991

[30] Foreign Application Priority Data

Oct. 1, 1990 [JP] Japan ..... 2-264578
Apr. 4, 1991 [JP] Japan ..... 3-71930

[51] Int. Cl.[5] ..... G09G 3/36
[52] U.S. Cl. ..... 340/784; 358/236
[58] Field of Search ..... 340/784, 805, 814, 768; 358/152, 140, 83, 148, 236; 315/169.4; 359/57

[56] References Cited

U.S. PATENT DOCUMENTS 4,389,668 6/1983 Favreau ..... 358/83
4,842,371 6/1989 Yasuda et al. ..... 340/784
5,030,888 7/1991 Salavin et al. ..... 340/805

*Primary Examiner*—Jeffery A. Brier
*Assistant Examiner*—A. Au
*Attorney, Agent, or Firm*—David G. Conlin; Robert F. O'Connell

[57] ABSTRACT

In a liquid crystal display apparatus in which a selection signal is simultaneously applied to two scanning signal lines, the application of the selection signal to one of the two scanning signal lines is terminated earlier than that of the selection signal to the other one of the two scanning signal lines. Alternatively, the level of the selection signal to one of the two scanning signal lines is made higher than that of the selection signal to the other one of the two scanning signal lines.

3 Claims, 11 Drawing Sheets

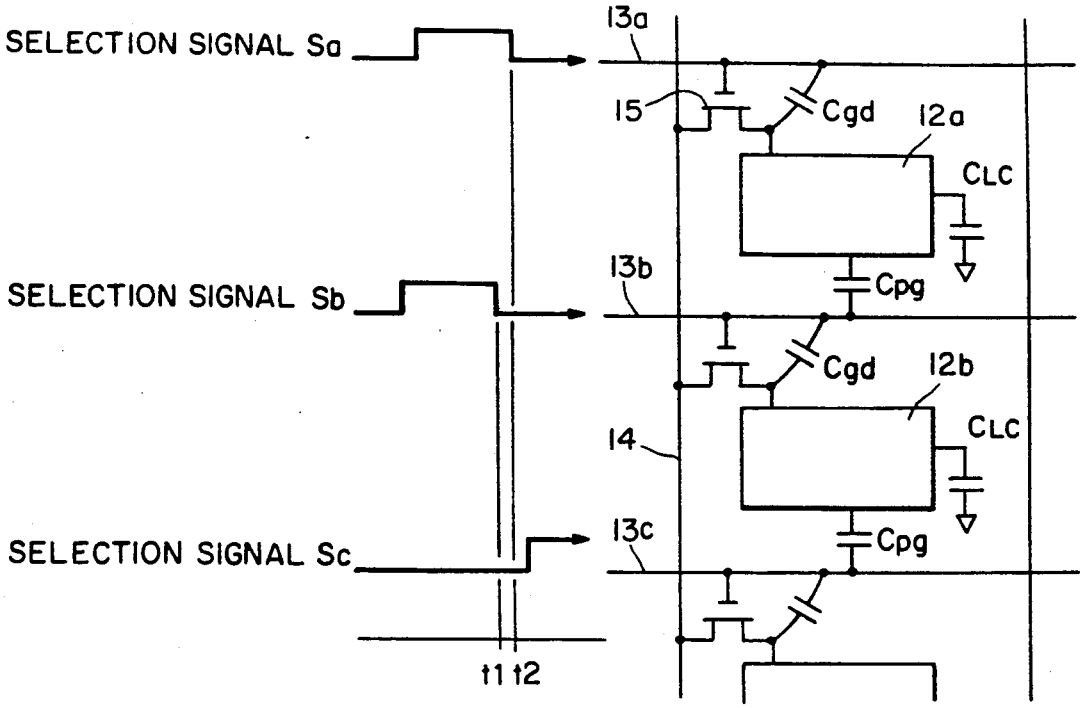
FIG. 1
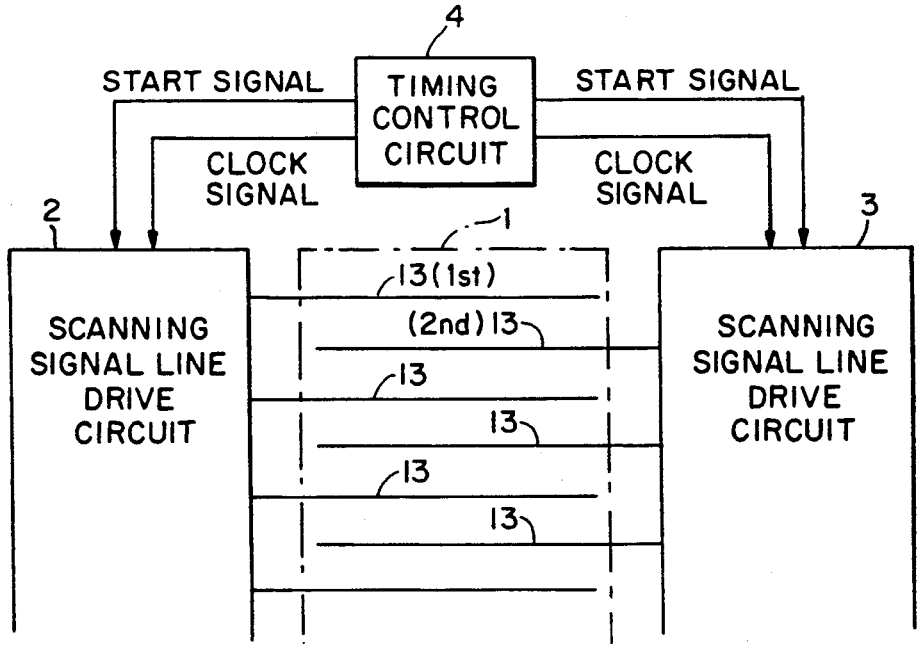

LIQUID CRYSTAL DISPLAY APPARATUS

BACKGROUND OF THE INVENTION

1. Field of the Invention

This invention relates to a display apparatus such as a liquid crystal display (LCD) apparatus, and more particularly to an active matrix LCD apparatus.

2. Description of the Prior Art

FIG. 13 diagrammatically shows an active matrix LCD apparatus which uses thin-film transistors (TFTs) as switching devices and in which two scanning signal lines are simultaneously scanned (hereinafter, this scanning method is referred to as "two-line simultaneous scanning method"). This TFT active matrix LCD apparatus comprises a large number of scanning signal lines 13 and data signal lines 14 formed on a substrate 11 which cross at right angles, and a matrix array of pixel electrodes 12 connected to these signal lines 13 and 14 via TFTs 15. A common opposite electrode (not shown) is disposed opposite to the TFT active matrix substrate with a liquid crystal layer interposed therebetween. In this construction, when a selection signal is applied to each of the scanning signal lines 13, data signals on the data signal lines 14 are fed via activated TFTs 15 to the pixel electrodes 12 connected to that scanning signal line 13. After the application of the selection signal is completed and the TFTs 15 are inactivated, the data signal potential is retained at each pixel electrode 12 by the capacitance of the liquid crystal layer, etc. The potential is regenerated at each application of the selection signal. Therefore, even in a matrix system in which the selection signal is sequentially applied to the scanning signal lines, data signal potential can be retained at each pixel electrode 12 and applied to the liquid crystal layer.

In the two-line simultaneous scanning method, as shown in FIG. 14, the selection signal is applied to two adjacent scanning signal lines 13 at the same time. When scanning an odd-numbered field, the selection signal is first applied simultaneously to the first and second scanning signal lines 13, and then, after one horizontal scanning period, to the third and fourth scanning lines 13. Thus, the selection signal is sequentially applied to each pair of an odd-numbered scanning signal line 13 and the succeeding even-numbered scanning signal line 13. On the other hand, when scanning an even-numbered field, the selection signal is first applied to the first scanning signal line 13, and then, after one horizontal scanning period, the selection signal is applied simultaneously to the second and third scanning signal lines 13, and thereafter to the fourth and fifth scanning signal lines 13. Thus, the selection signal is simultaneously applied to two adjacent scanning signal lines 13 paired differently from when scanning an odd-numbered field. Accordingly, as compared to a simple scanning method in which the selection signal is applied to one scanning signal line 13 at one time, the two-line simultaneous scanning method requires two times more scanning signal lines 13 and pixel electrodes 12, but can produce a high-resolution image conforming to the interlaced scanning system. The two-line simultaneous scanning method is described in detail in U.S. patent application Ser. No. 07/476,536 filed on Feb. 7, 1990 and EPC patent application No. 90301414.0 filed on Feb. 9, 1990. These are incorporated herein as references.

Upon the completion of the application of the selection signal, the potential at each of the pixel electrodes

12 connected to the scanning signal lines 13 to which the selection signal has been applied drops to a lower level than the data signal potential because of the effect of a parasitic capacitance $C_{gd}$ between the gate and drain of the activated TFT 15. In the case of the simple scanning method, when the gate voltages at the activation and inactivation of the TFT 15 are denoted as $V_{GH}$ and $V_{GL}$, respectively, and the capacitance of the liquid crystal layer at the pixel electrode 12 is denoted as $C_{LC}$, the potential drops below the data signal potential approximately by the potential $\Delta V$ indicated by the following expression (1).

$$\Delta V = \frac{C_{gd}}{C_{LC} + C_{gd}} (V_{GH} - V_{GL}) \quad (1)$$

In the simple scanning method, however, such a potential drop occurs equally to every pixel electrode 12. Therefore, by shifting the opposite voltage applied to the opposite electrode by a value equivalent to the potential drop $\Delta V$, the DC component of the voltage applied to the liquid crystal layer by the AC drive can be easily maintained at zero.

In the two-line simultaneous scanning method, on the other hand, the effect of a stray capacitance $C_{pg}$ between the pixel electrode and a scanning signal line not connected but adjacent to the pixel electrode must also be considered in addition to the parasitic capacitance $C_{gd}$. That is, when selection signals Sa and Sb are applied to scanning signal lines 13*a* and 13*b*, as shown in FIG. 15, thereby selecting the rows to which pixel electrodes 12*a* and 12*b* are connected, the pixel electrode 12*a* disposed between the scanning signal lines 13*a* and 13*b* and connected to the scanning signal line 13*a* experiences a potential drop $\Delta V1$ indicated by the following expression (2), when the application of the selection signal Sa is completed. This is because the scanning signal line 13*b* which is not connected but adjacent to the pixel electrode 12*a* also experiences a potential variation as the selection signal Sb is applied to it.

$$\Delta V1 = \frac{C_{gd} + C_{pg}}{C_{LC} + C_{gd} + C_{pg}} (V_{GH} - V_{GL}) \quad (2)$$

However, regarding the other pixel electrode 12*b*, since the selection signal is not yet applied to the scanning signal line 13*c* not connected but adjacent to the pixel electrode 12*b* and therefore no potential variation occurs, the potential drop $\Delta V2$ at the pixel electrode 12*b* is indicated by the following expression (3).

$$\Delta V2 = \frac{C_{gd}}{C_{LC} + C_{gd} + C_{pg}} (V_{GH} - V_{GL}) \quad (3)$$

As a result, although the pixel electrodes 12*a* and 12*b* are connected to the same data signal line 14 and supplied with the same data signal voltage, a difference arises between the potential drops $\Delta V1$ and $\Delta V2$ when the application of the selection signal is completed, and thereafter the pixel electrode 12*b* retains a higher potential.

Accordingly, a prior art liquid crystal display has the problem that when the selection signal is applied simultaneously to a plurality of scanning signal lines, there occurs a difference in brightness between adjacent pixels on the same data signal line, resulting in a degradation in the image quality.

SUMMARY OF THE INVENTION

The display apparatus of this invention, which overcomes the above-discussed and numerous other disadvantages and deficiencies of the prior art, comprises: a display panel having scanning signal lines arranged in parallel, data signal lines, switching elements which are controlled by a signal supplied through said scanning signal lines, pixel electrodes connected to said data signal lines through said switching elements; and drive means for simultaneously applying said signal to at least two succeeding ones of said scanning signal lines, and said drive means comprises timing control means for terminating the application of said signal to one of said at least two scanning signal lines earlier than the application of said signal to another one of said at least two scanning signal lines.

Preferably, said one scanning signal line is disposed between a pixel electrode to which said one scanning signal line is connected and another pixel electrode to which said other one scanning signal line is connected.

Preferably, said drive means comprises clock signal means for supplying at least two clock signals which are phase-shifted from each other.

According to the above-mentioned display apparatus, as shown in FIG. 1, selection signals Sa and Sb are respectively applied to scanning signal lines 13*a* and 13*b* at the same time, and the selection signal Sb is terminated faster (at time $t_1$) which is applied to the scanning signal line 13*b* disposed between two pixel electrodes 12*a* and 12*b* which are respectively connected to the scanning signal lines 13*a* and 13*b*. Since there is no variation in the potential of the scanning signal line 13*c*, the potential drop $\Delta V$ at the pixel electrode 12*b* in this case has the value indicated by above-mentioned expression (3). When the application of the selection signal Sb for the scanning signal line 13*b* is terminated faster as mentioned above, the potential of the pixel electrode 12*a* which is adjacent through the stray capacitance $C_{pg}$ is also affected by this termination so as to decrease once. Since the TFT 15 remains conductive at this time and the pixel electrode 12*a* is connected to the data signal line 14, however, the pixel electrode 12*a* is immediately charged so as to return to the potential of the data signal.

Then, the application of the selection signal Sa for the scanning signal line 13*a* is terminated at time $t_2$. At this time, the potential change at the adjacent scanning signal line 13*b* has already ended. Therefore, the potential drop $\Delta V$ at the pixel electrode 12*a* changes in the same manner as that of the pixel electrode 12*b*, and the potential drop $\Delta V$ has a value indicated by expression (4).

$$\Delta V = \frac{C_{gd}}{C_{LC} + C_{gd} + C_{pg}} (V_{GH} - V_{GL}) \tag{4}$$

According to the display apparatus of the invention, even when selection signals are respectively applied to two scanning signal lines at the same time, the potentials of pixel electrodes connected to the two scanning signal lines drop in the same degree so that these pixel electrodes have the same potential, whereby a uniform display can be attained.

In another aspect of the invention, the display apparatus comprises: a display panel having scanning signal lines arranged in parallel, data signal lines, switching elements which are controlled by a signal supplied through said scanning signal lines, pixel electrodes connected to said data signal lines through said switching elements; and drive means for simultaneously applying said signal to at least two succeeding ones of said scanning signal lines, and said drive means comprises voltage means for making the level of said signal applied to one of said at least two scanning signal lines higher than the level of said signal applied to another one of said at least two scanning signal lines.

Preferably, said one scanning signal line is disposed between a pixel electrode to which said one scanning signal line is connected and another pixel electrode to which said other one scanning signal line is connected.

In the above-mentioned display apparatus, as shown in FIG. 7, selection signals Sa and Sb are respectively applied to scanning signal lines 13*a* and 13*b* at the same time. The level $V_{GH}2$ of the selection signal Sb applied to the scanning signal line 13*b* which is disposed between pixel electrodes 12*a* and 12*b* is higher than the level $V_{GH}1$ of the selection signal Sa applied to the scanning signal line 13*a*. These voltage levels $V_{GH}1$ and $V_{GH}2$ are selected so as to be sufficiently higher than the threshold value of the TFTs 15*a* and 15*b*. When the application of the selection signals Sa and Sb to the scanning signal lines 13*a* and 13*b* is terminated, the potentials at the pixel electrodes 12*a* and 12*b* drop due to the coupling caused by the parasitic capacitance $C_{gd}$ and stray capacitance $C_{pg}$. However, since the levels of the selection signal voltages are different between the scanning signal lines, the potential drops $\Delta V1'$ and $\Delta V2'$ at the pixel electrodes 12*a* and 12*b* take the values indicated by the following expressions (5) and (6), respectively.

$$\Delta V1' = \frac{C_{gd} + C_{pg}}{C_{LC} + C_{gd} + C_{pg}} (V_{GH}1 - V_{GL}) \tag{5}$$

$$\Delta V2' = \frac{C_{gd}}{C_{LC} + C_{gd} + C_{pg}} (V_{GH}2 - V_{GL}) \tag{6}$$

If $\Delta V1' = \Delta V2'$, the potentials retained at the pixel electrodes 12*a* and 12*b* will become equal. Therefore, by predetermining voltage levels $V_{GH}1$ and $V_{GH}2$ in such a way as to satisfy the following expression (7), the potential drop can be equalized between the pixel electrodes 12*a* and 12*b*, thus making equal the potentials retained at the pixel electrodes 12*a* and 12*b*.

$$(C_{gd} + C_{pg})(V_{GH}1 - V_{GL}) = C_{gd}(V_{GH}2 - V_{GL}) \tag{7}$$

Thus, according to the LCD apparatus of the invention, when selection signals are applied simultaneously to two scanning signal lines, an equal potential drop is achieved at the end of the application of the selection signals, thereby allowing every pixel electrode to retain the same potential and thus accomplishing a uniform display of an image.

Thus, the invention described herein makes possible the objectives of:

(1) providing a display apparatus in which variations in brightness among pixels do not occur even when the two-line simultaneous scanning method is employed;

(2) providing a display apparatus which can display an image with excellent display quality even when the two-line simultaneous scanning method is employed;

(3) providing a display apparatus in which the potential drop at the end of the application of the selection signal can be made equal between the scanning signal lines; and (4) providing a display apparatus in which the pixel electrodes can retain the potentials of the same value.

BRIEF DESCRIPTION OF THE DRAWINGS

This invention may be better understood and its numerous objects and advantages will become apparent to those skilled in the art by reference to the accompanying drawings as follows:

FIG. 1 is a diagram illustrating the operation of a first embodiment of the invention.

FIG. 2 is a block diagram illustrating the first embodiment.

DESCRIPTION OF THE PREFERRED EMBODIMENTS

Figure 13:
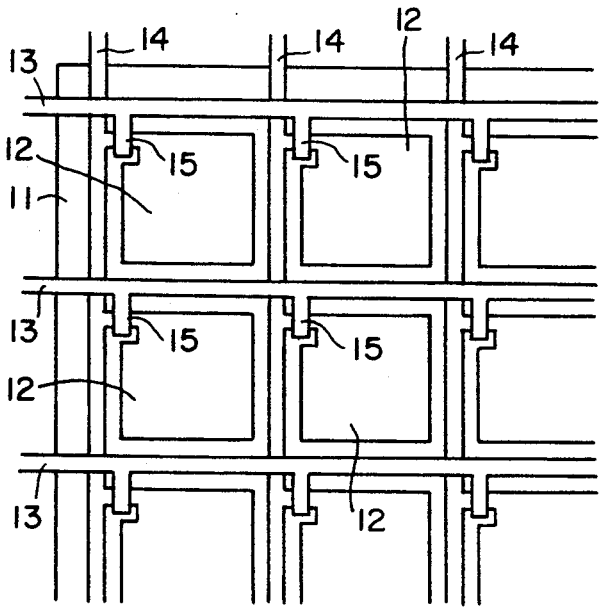
FIG. 13 is a partial plan view of an active matrix LCD apparatus.

FIG. 2 shows an embodiment of the invention. This embodiment is a TFT active matrix LCD apparatus which is useful in a color television receiver for the NTSC (National Television System Committee) standard. This embodiment comprises a TFT active liquid crystal panel 1 on which, in the same manner as shown in FIG. 13, large numbers of pixel electrodes 12*a*, 12*b*, . . . , scanning signal lines 13*a*, 13*b*, . . . , data signal lines 14, and TFTs 15*a*, 15*b*, . . . are formed. Each of the pixel electrodes 12*a*, 12*b*, . . . is connected to the adjacent data signal line 14 via the respective TFT 15*a*, 15*b*, . . . . The gate of each of the TFTs 15*a*, 15*b*, . . . is connected to the adjacent scanning signal line 13*a*, 13*b*, . . . . When a selection signal of a high level is applied to one of the scanning signal lines 13*a*, 13*b*, . . . , the TFT connected to that scanning signal line becomes conductive.

The scanning signal lines 13*a*, 13*b*, . . . are arranged in such a way that the even-numbered lines and the odd-numbered lines are directed in opposite directions to each other, as shown in FIG. 2. The odd-numbered scanning signal lines 13*a*, 13*c*, . . . are connected to a scanning signal line drive circuit 2, while the even-numbered scanning signal lines 13*b*, 13*d*, . . . are connected to another scanning signal line drive circuit 3.

Figure 3:
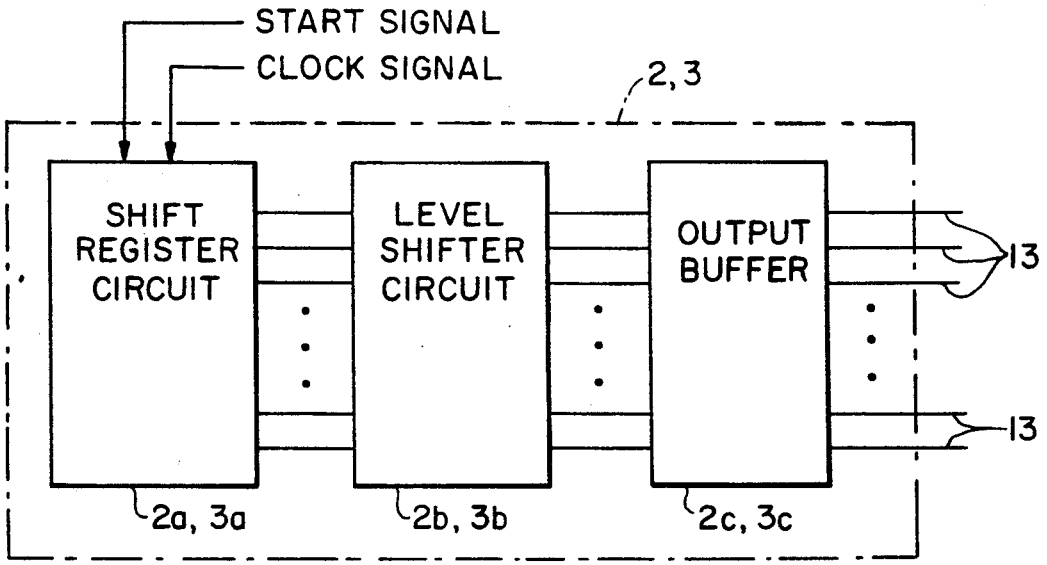
FIG. 3 is a block diagram illustrating a scanning signal line drive circuit used in the first embodiment.

As shown in FIG. 3, the scanning signal line drive circuits 2 and 3 comprise a shift register circuit 2*a*, 3*a* for shifting a start signal in response to a clock signal, a level shifter circuit 2*b*, 3*b* for raising the output of the shift register circuit 2*a*, 3*a* to a level necessary to drive the TFTs, and an output buffer 2*c*, 3*c* for holding the output of the level shifter circuit 2*b*, 3*b* and outputting it to the scanning signal lines. A timing control circuit 4 produces a start signal from which the selection signal is created and a clock signal which defines one horizontal scanning period, and supplies them to the shift register circuits 2*a* and 3*a*.

Figure 4:
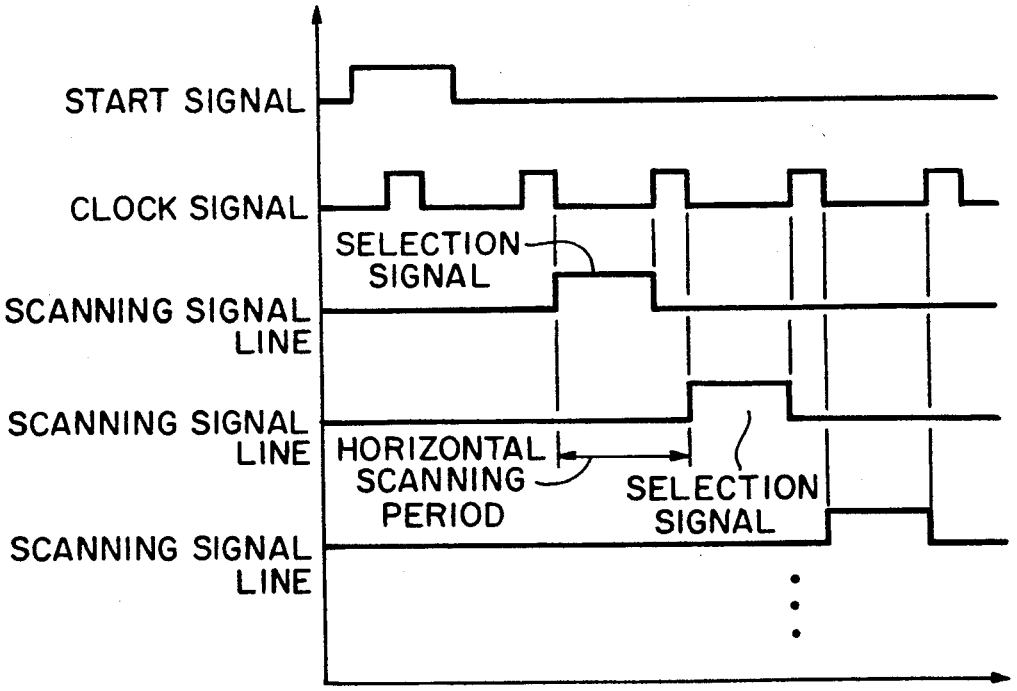
FIG. 4 is a timing chart illustrating the principal operation of a scanning signal line drive circuit used in the first embodiment.

The timing control circuit 4 outputs the start signal and clock signal in response to a synchronizing signal separated from the video signal. The start signal is output in synchronism with a vertical synchronizing signal and is supplied simultaneously to the scanning signal line drive circuits 2 and 3 in an odd-numbered field. On the other hand, in an even-numbered field, the start signal supplied to the scanning signal line drive circuit 2 is delayed by one horizontal scanning period to supply to the scanning signal line drive circuit 3. As a result, the selection signal generated by sequentially shifting the start signal is successively output with a delay of one horizontal scanning period to the scanning signal lines 13*a*, 13*b*, . . . connected to the scanning signal line drive circuits 2 and 3. As shown in FIG. 4, selection signals which are obtained by sequentially shifted the start signal by one horizontal scanning period are supplied to the scanning lines. Each of the selection signal rises in synchronism with the falling of the preceding clock signal and falls in synchronism with the rising of the succeeding clock signal.

In this embodiment, the timing control circuit 4 outputs the clock signal in the manner described below. In an odd field, the phase of the clock signal supplied to the scanning signal line drive circuit 3 slightly leads that of the clock signal supplied to the scanning signal line drive circuit 2, and in an even field the phase of the clock signal supplied to the scanning signal line drive circuit 3 is slightly delayed from that of the clock signal supplied to the scanning signal line drive circuit 2.

Figure 5:
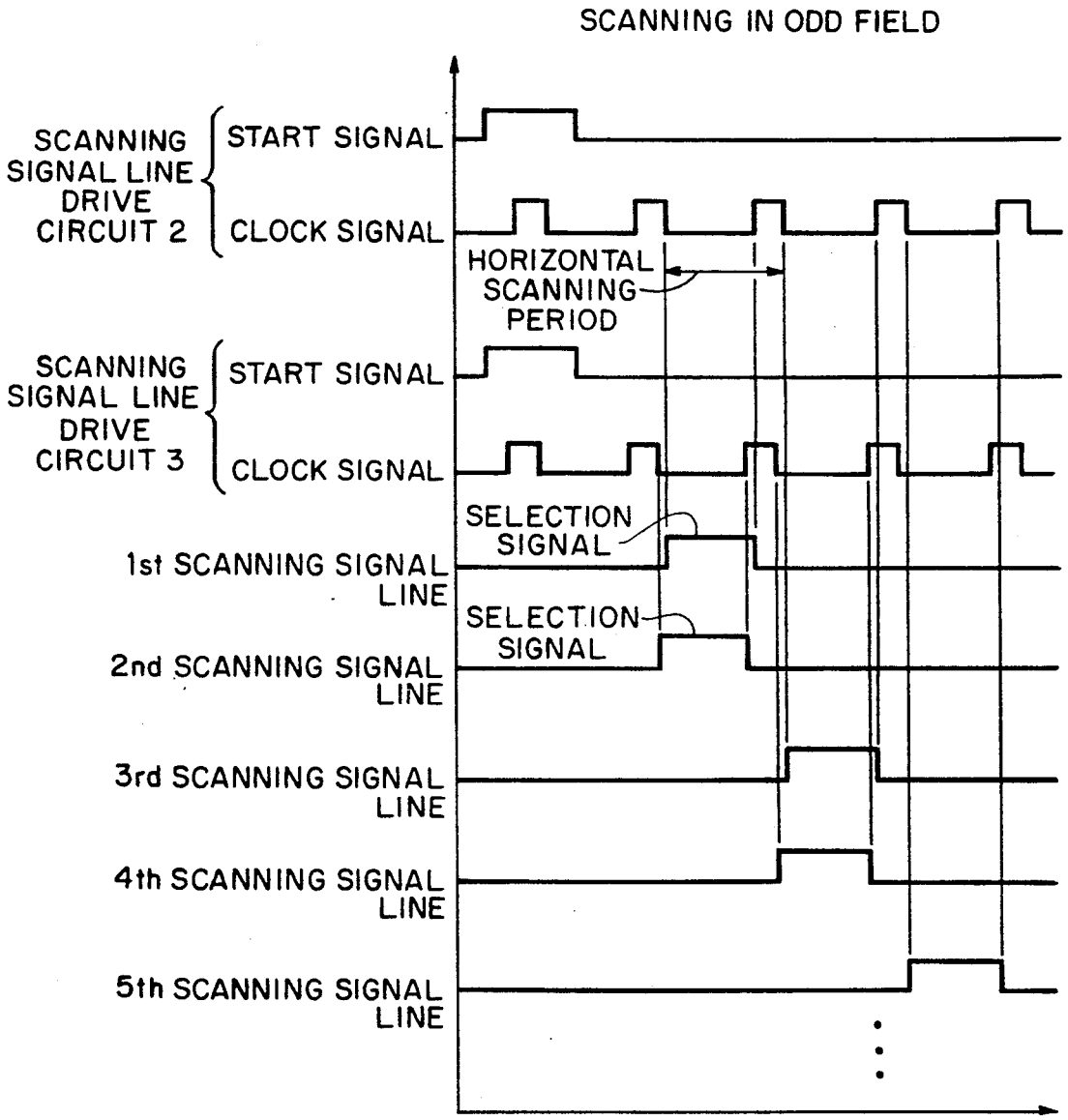
FIG. 5 is a timing chart illustrating the operation of the first embodiment in an odd field.
Figure 6:
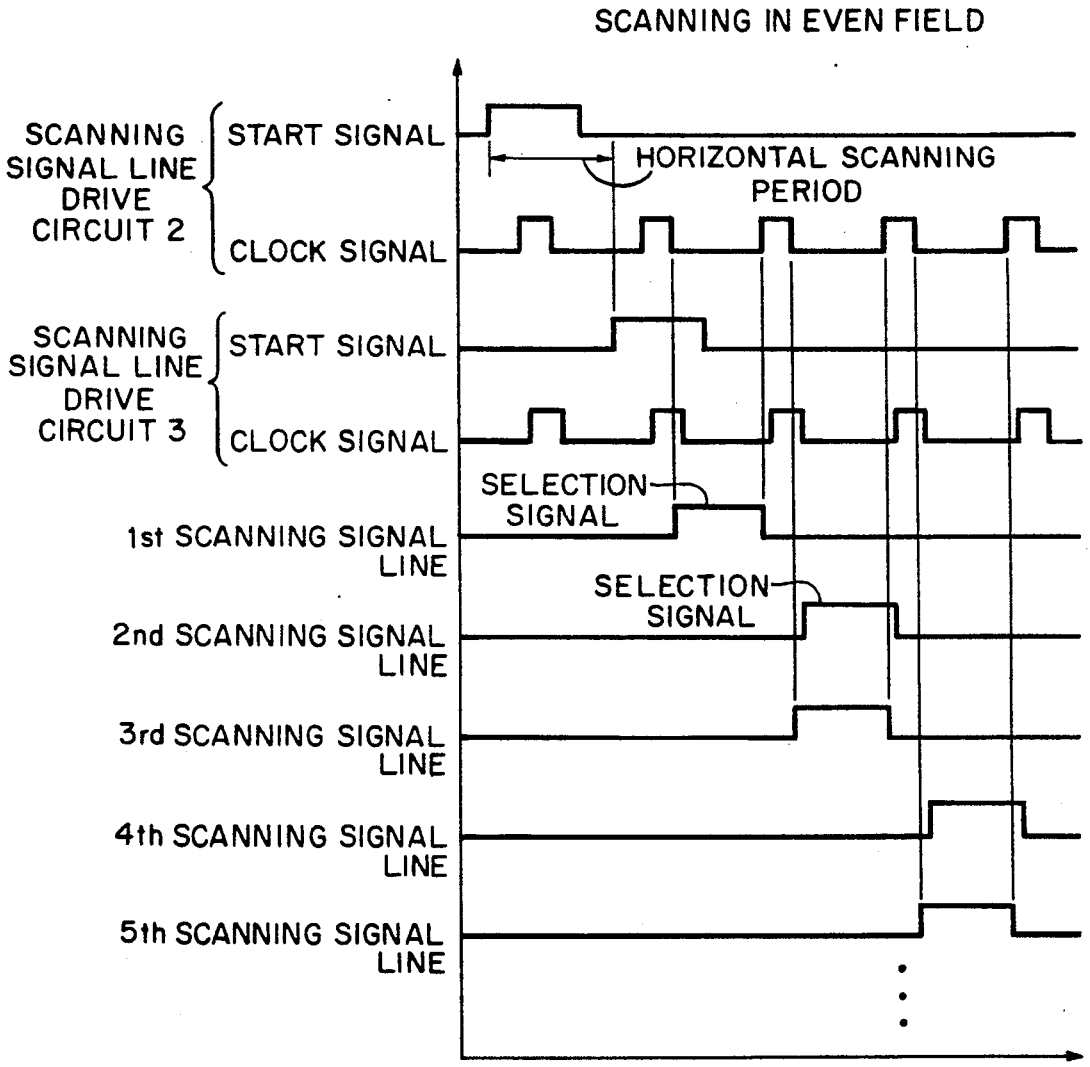
FIG. 6 is a timing chart illustrating the operation of the first embodiment in an even field.
Figure 7:
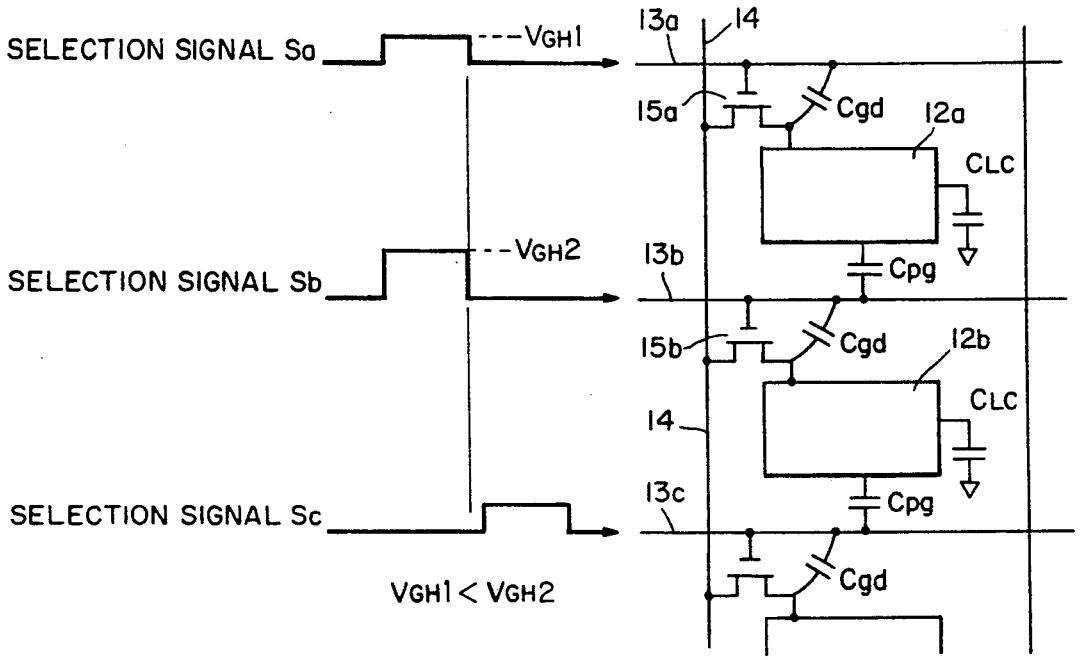
FIG. 7 is a diagram illustrating the operation of a second embodiment of the invention.
Figure 9:
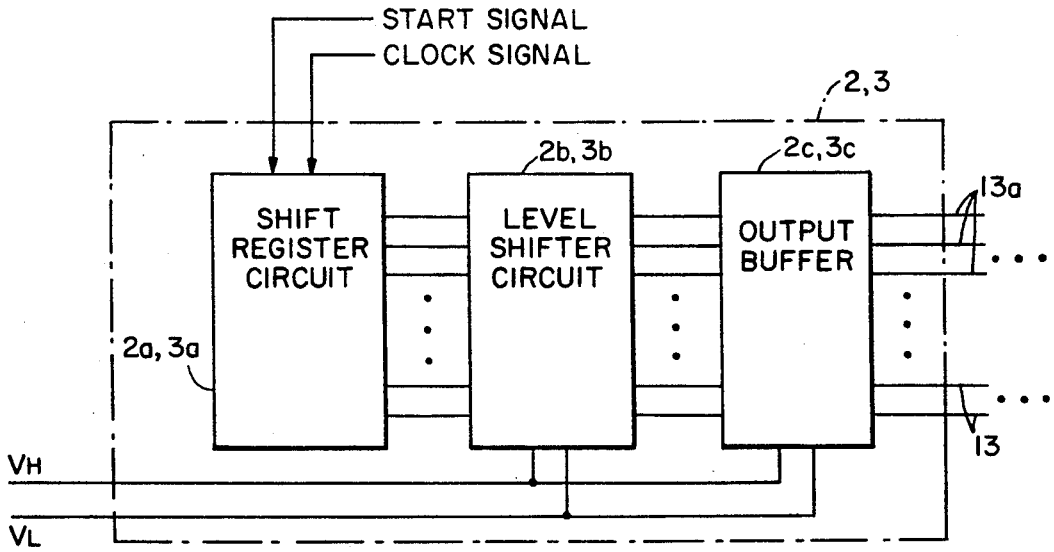
FIG. 9 is a block diagram illustrating a scanning signal line drive circuit used in the second embodiment.

The operation of this embodiment will be described with reference to FIGS. 5 and 6. In the scanning of an odd-numbered field in accordance with the interlaced scanning system, the start signal is supplied simultaneously to the scanning signal line drive circuits 2 and 3. Therefore, the selection signal is first applied simultaneously to the first and second scanning signal lines 13*a* and 13*b*, and after one horizontal scanning period to the scanning signal lines 13*c* and 13*d*. Thereafter, the selection signal is applied sequentially to each pair of an odd-numbered scanning line and the succeeding even-numbered scanning line. On the other hand, in the scanning of an even-numbered field, the start signal is first fed to the scanning signal line drive circuit 2 from the timing control circuit 4, and after one horizontal scanning period, the start signal is supplied to the scanning signal line drive circuit 3. This means that the selection signal is first applied to the first scanning signal line 13*a*, and after one horizontal scanning period the selection signal is applied simultaneously to the second and third scanning signal lines 13*b* and 13*c*, and then to the scanning signal lines 13*d* and 13*e*, the selection signal thus being applied to each pair of an even-numbered line and the succeeding odd-numbered line. Thus, the pixels in the liquid crystal panel 1 are activated so that in an odd field the odd-numbered scanning lines each paired with the succeeding even-numbered scanning line are displayed while in an even field the even-numbered scanning lines each paired with the succeeding odd-numbered scanning line are displayed, thereby accomplishing the display of a high-resolution image by the two-line simultaneous scanning method conforming to the interlaced scanning system.

In an odd field, the phase of the clock signal supplied to the scanning signal line drive circuit 3 is slightly advanced as described above. Hence, the application of the selection signal to an even-numbered scanning signal line starts and terminates earlier than that to an odd-numbered scanning signal lines. This means that the scanning signal line 13*a* shown in FIG. 1 corresponds to an odd-numbered scanning signal line and the scanning signal line 13*b* shown in FIG. 1 to an even-numbered scanning signal line. The potential of a pixel electrode (12*b* in FIG. 1) connected to an even-numbered line (13*b* in FIG. 1) on which the application of the selection signal terminates earlier is lowered from the potential of a data signal by the potential drop $\Delta V$ indicated by expression (4), because the potential of the adjacent scanning signal line (13*c* in FIG. 1) does not change. The potential of a pixel electrode (12*a* in FIG. 1) connected to an odd-numbered line (13*a* in FIG. 1) on which the application of the selection signal terminates later is lowered from the potential of a data signal by the same degree as the potential drop $\Delta V$, because the potential of the adjacent scanning signal line (13*b* in FIG. 1) has already changed.

By contrast, in an even field, the phase of the clock signal supplied to the scanning signal line drive circuit 3 is slightly delayed. Hence, the application of the selection signal to an odd-numbered scanning signal line starts and terminates earlier than that to an even-numbered scanning signal lines. This means that the scanning signal line 13*a* shown in FIG. 1 corresponds to an even-numbered scanning signal line and the scanning signal line 13*b* shown in FIG. 1 to an odd-numbered scanning signal line. The potential of a pixel electrode (12*b* in FIG. 1) connected to an odd-numbered line (13*b* in FIG. 1) on which the application of the selection signal terminates earlier is lowered from the potential of a data signal by the degree same as the potential drop $\Delta V$ indicated by expression (4), because the potential of the adjacent scanning signal line (13*c* in FIG. 1) does not change. The potential of a pixel electrode (12*a* in FIG. 1) connected to an even-numbered line (13*a* in FIG. 1) on which the application of the selection signal terminates later is lowered from the potential of a data signal by the same degree as the potential drop $\Delta V$, because the potential of the adjacent scanning signal line (13*b* in FIG. 1) has already changed.

According to the embodiment of the invention, when the selection signal is applied simultaneously to two scanning signal lines by the two-line simultaneous scanning method conforming to the interlaced scanning system, the potential drop at the end of the application of the selection signal is equal at each pixel electrode on every scanning line, thereby allowing every pixel electrode to retain the same potential and thus accomplishing the display of a uniform image.

In order to equalize the application period of the selection signal to the scanning signal lines, the timing of the rising of the selection signal may be slightly different in accordance with the timing of the falling of the selection signal. The invention is also applicable to the case that three or more scanning lines are simultaneously supplied with a selection signal. In this case, the timing of terminating the application of a selection signal is sequentially shifted for each pair of adjacent two lines of these scanning lines.

Figure 8:
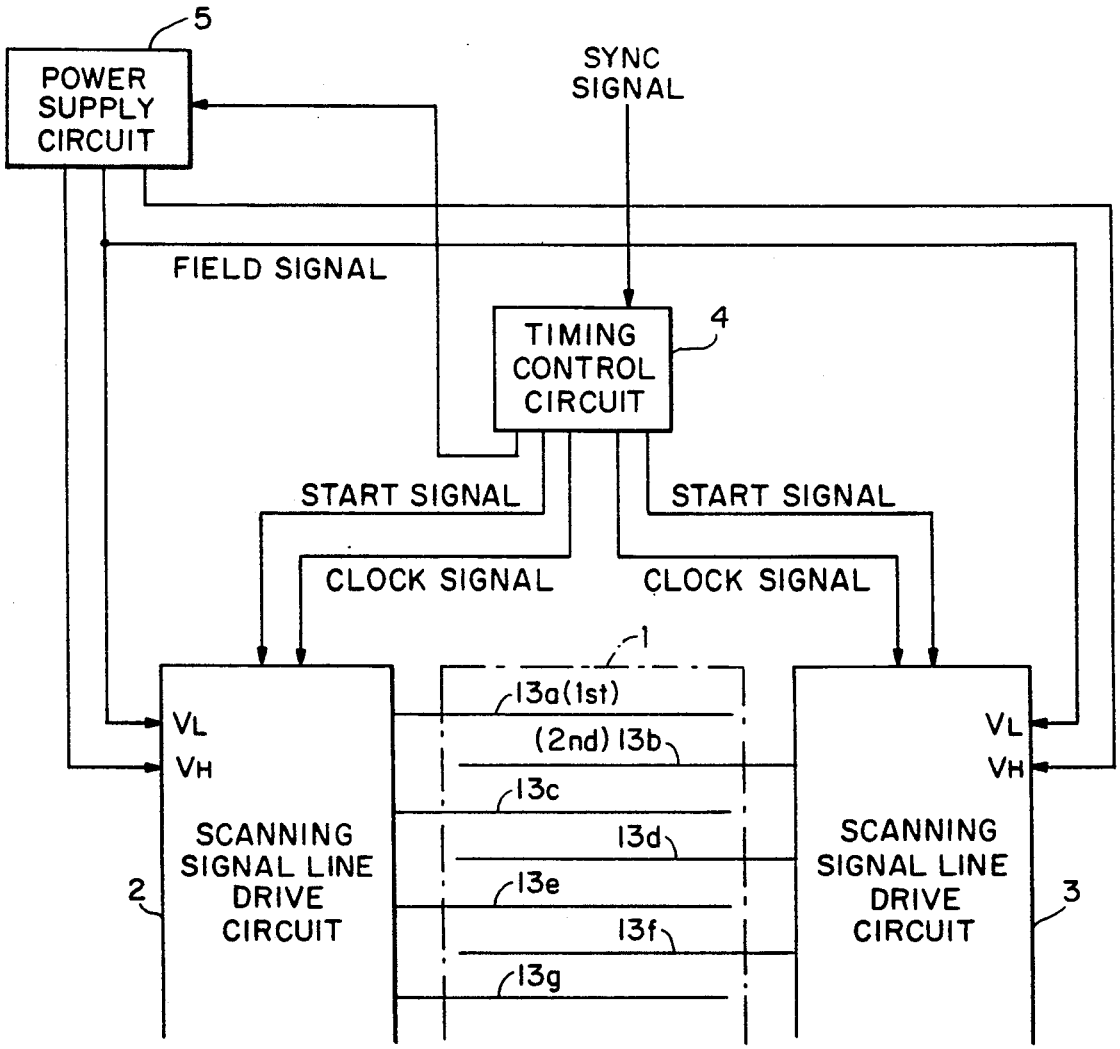
FIG. 8 is a block diagram illustrating the second embodiment.
Figure 10:
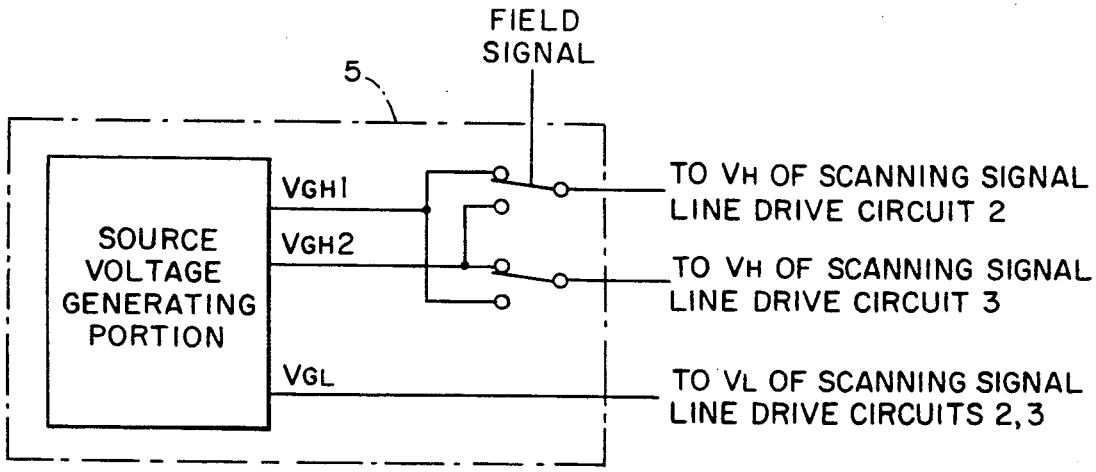
FIG. 10 diagrammatically shows a circuit for supplying voltages to a scanning signal line drive circuit and a timing chart applying the voltages.
Figure 10:
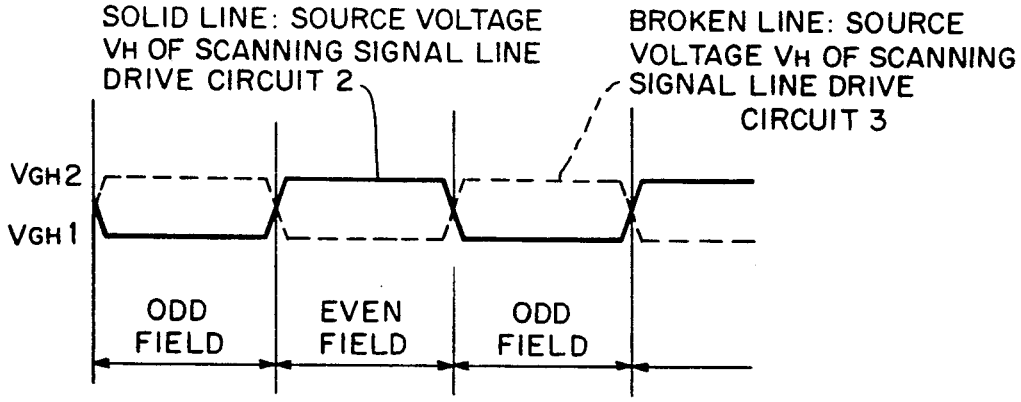

FIG. 8 shows another embodiment of the invention. This embodiment further comprises a power supply circuit 5. When the selection signal is activated, a higher voltage $V_H$ is selected, and, when the selection signal is not activated, a lower voltage $V_L$ is selected. In this embodiment, the timings of supplying the clock signal to the scanning signal line drive circuits 2 and 3 are the same. As shown in FIG. 10, the power supply circuit 5 receives a field signal indicative of the current field, and changes the level of the higher voltage $V_H$ in accordance with the field signal. Namely, during an odd field, the power supply circuit 5 supplies a voltage $V_{GH}1$ to the scanning signal line drive circuit 2, and a voltage $V_{GH}2$ (higher than the voltage $V_{GH}1$) to the scanning signal line drive circuit 3. On the other hand, during an even field, the voltage $V_{GH}2$ is supplied to the scanning signal line drive circuit 2, and the voltage $V_{GH}1$ supplied to the scanning signal line drive circuit 3. The voltages $V_{GH}1$ and $V_{GH}2$ are predetermined so that the relationship expressed by foregoing expression (7) can be established among the parasitic capacitance $C_{gd}$ between the gate and drain of the associated TFT 15, the stray capacitance $C_{pg}$, and the value $V_{GL}$ of the source voltage $V_L$ applied to the scanning signal line drive circuits 2 and 3 (the voltage applied to the scanning signal lines 13*a*, 13*b*, . . . during the non-activation of the selection signal).

Figure 11:
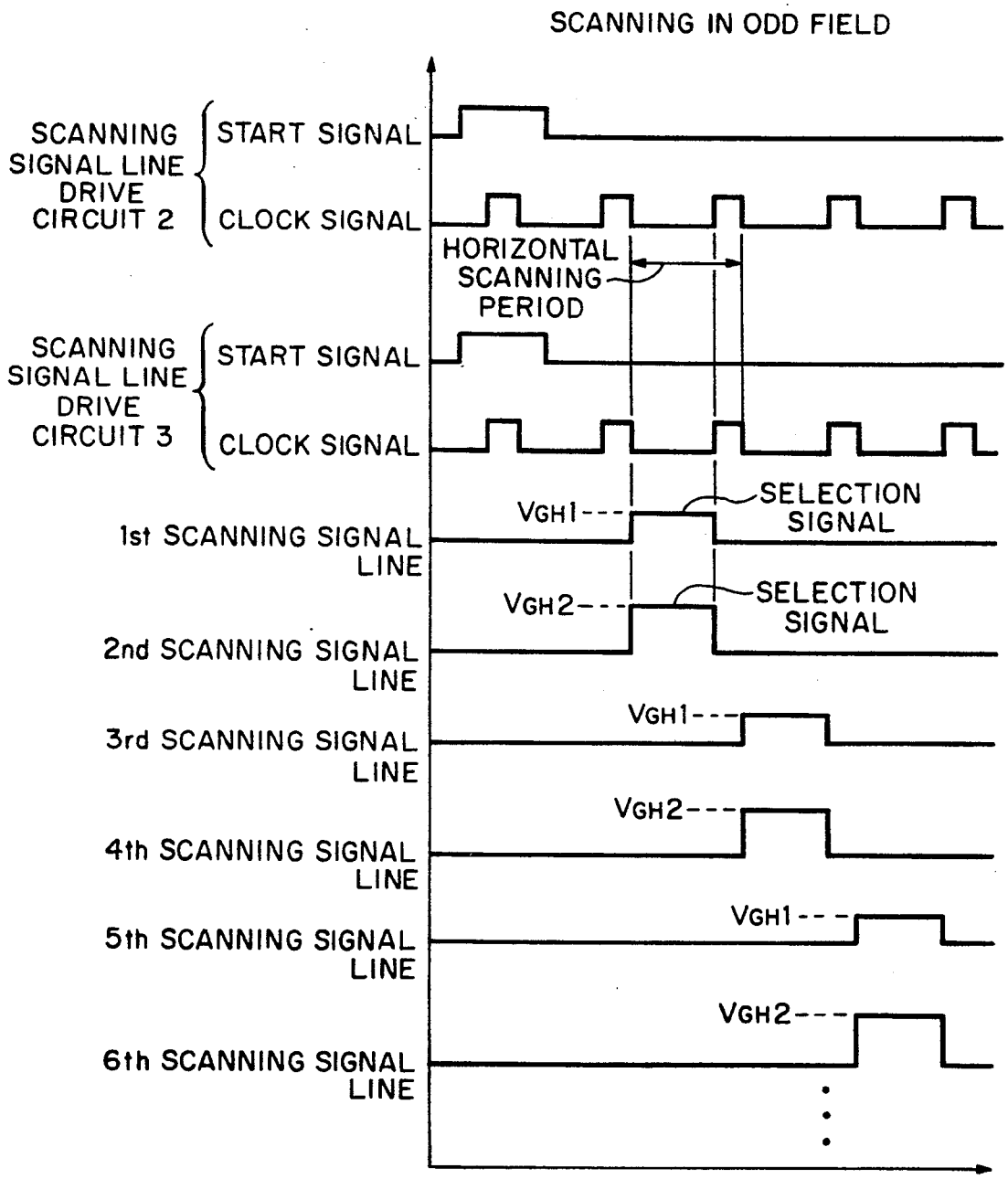
FIG. 11 is a timing chart illustrating the operation of the second embodiment in an odd field.
Figure 12:
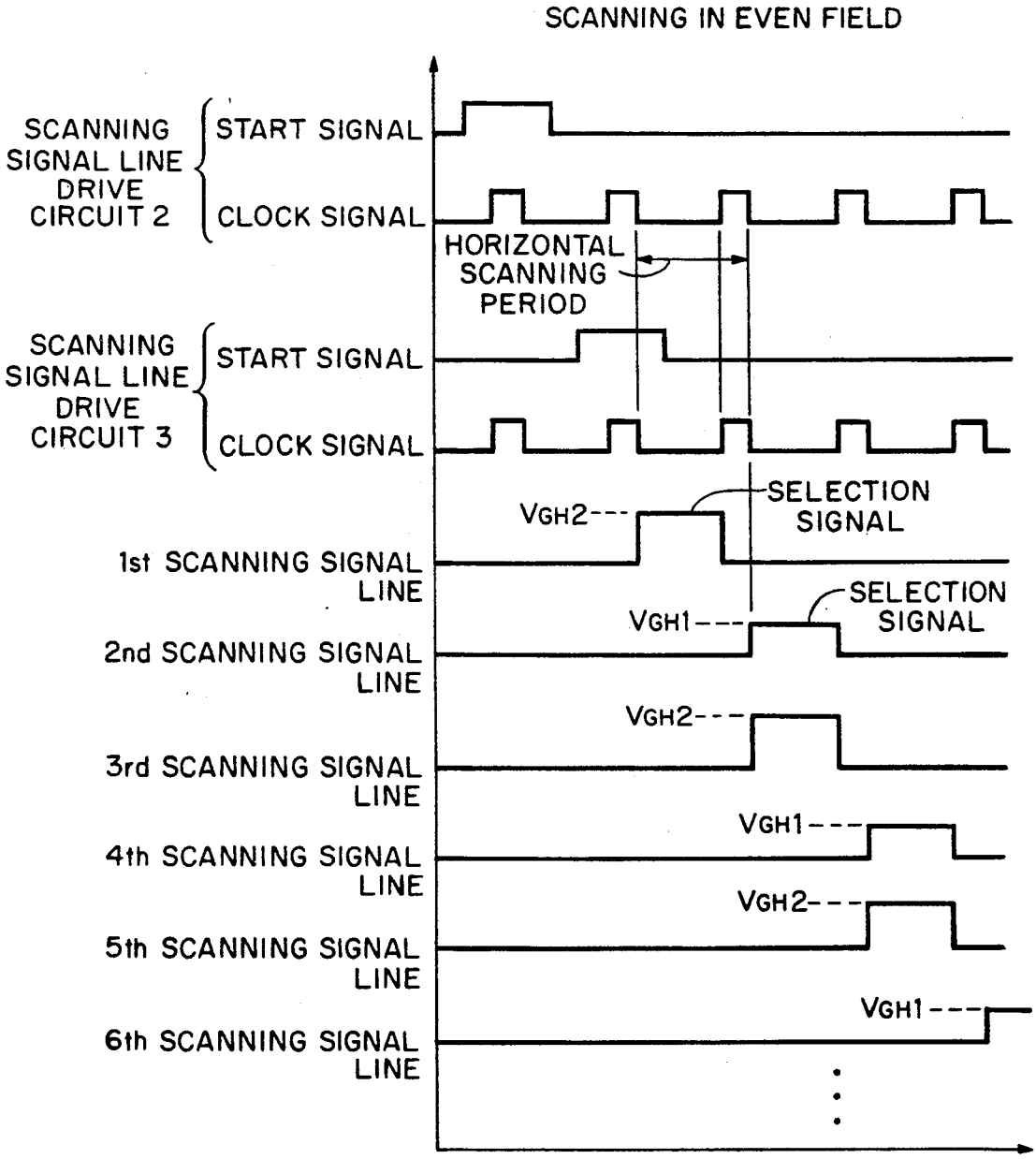
FIG. 12 is a timing chart illustrating the operation of the second embodiment in an even field.

The operation of this embodiment will be described referring to FIGS. 11 and 12. The manner of supplying selection signals to the scanning signal lines is the same as described with reference to FIG. 4. In an odd field, since the value $V_{GH}2$ of the source voltage $V_H$ applied to the scanning signal line drive circuit 3 is higher than the value $V_{GH}1$ of the source voltage $V_H$ applied to the scanning signal line drive circuit 2, the selection signal applied simultaneously to each pair of scanning signal lines 13*a*, 13*b*, . . . provides a higher voltage to the even-numbered scanning lines 13*b*, 13*d*, . . . than to the odd-numbered scanning lines 13*a*, 13*c*, . . . . As a result, the potential retained at the pixel electrode 12*a* and that retained at the pixel electrode 12*b* after the completion of the application of the selection signal are both lower than the data signal potential by the potential drops $\Delta V1'$ and $\Delta V2'$ respectively indicated by expressions (5) and (6). According to the condition by expression (7), $\Delta V1' = \Delta V2'$, and therefore the pixel electrodes 12*a* and 12*b* retain the potential of the same value.

In an even field, since the value $V_{GH}2$ of the source voltage $V_H$ applied to the scanning signal line drive circuit 2 is higher than the value $V_{GH}1$ of the source voltage $V_H$ applied to the scanning signal line drive circuit 3, the selection signal applied simultaneously to each pair of scanning signal lines 13*a*, 13*b*, . . . provides a higher voltage to the odd-numbered scanning lines 13*a*, 13*c*, . . . than to the even-numbered scanning lines 13*b*, 13*d*, . . . . As a result, the potential retained at the pixel electrode 12*a* and that retained at the pixel electrode 12*b* after the completion of the application of the selection signal are both lower than the data signal potential by the potential drops $\Delta V2'$ and $\Delta V1'$. As described above, $\Delta V1' = \Delta V2'$, and therefore the pixel electrodes 12*a* and 12*b* retain the potential of the same value.

As is apparent from the above description, according to the invention, even when the selection signal is applied simultaneously to a plurality of adjacent scanning signal lines, the potential drop at the end of the application of the selection signal can be made equal between the scanning signal lines, allowing the pixel electrodes to retain the potentials of the same value and thereby accomplishing the display of a uniform image.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A display apparatus comprising: a display panel having scanning signal lines arranged in parallel, data signal lines, switching elements which are controlled by a signal supplied through said scanning signal lines, pixel electrodes connected to said data signal lines through said switching elements; and drive means for simultaneously applying said signal to at least two succeeding ones of said scanning signal lines, said drive means comprising timing control means for terminating the application of said signal to one of said at least two scanning signal lines earlier than the termination of the application of said signal to another one of said at least two scanning signal lines.

2. A display apparatus according to claim 1, wherein said one scanning signal line is disposed between a pixel electrode to which said one scanning signal line is connected and another pixel electrode to which said other one scanning signal line is connected.

3. A display apparatus according to claim 1, wherein said drive means comprises clock signal means for supplying at least two clock signals which are phase-shifted from each other.

* * * * *

UNITED STATES PATENT AND TRADEMARK OFFICE

CERTIFICATE OF CORRECTION

PATENT NO. : 5,206,634

DATED : April 27, 1993

INVENTOR(S) : T. Matsumoto; K. Tanaka and K. Kato

Figure 14:
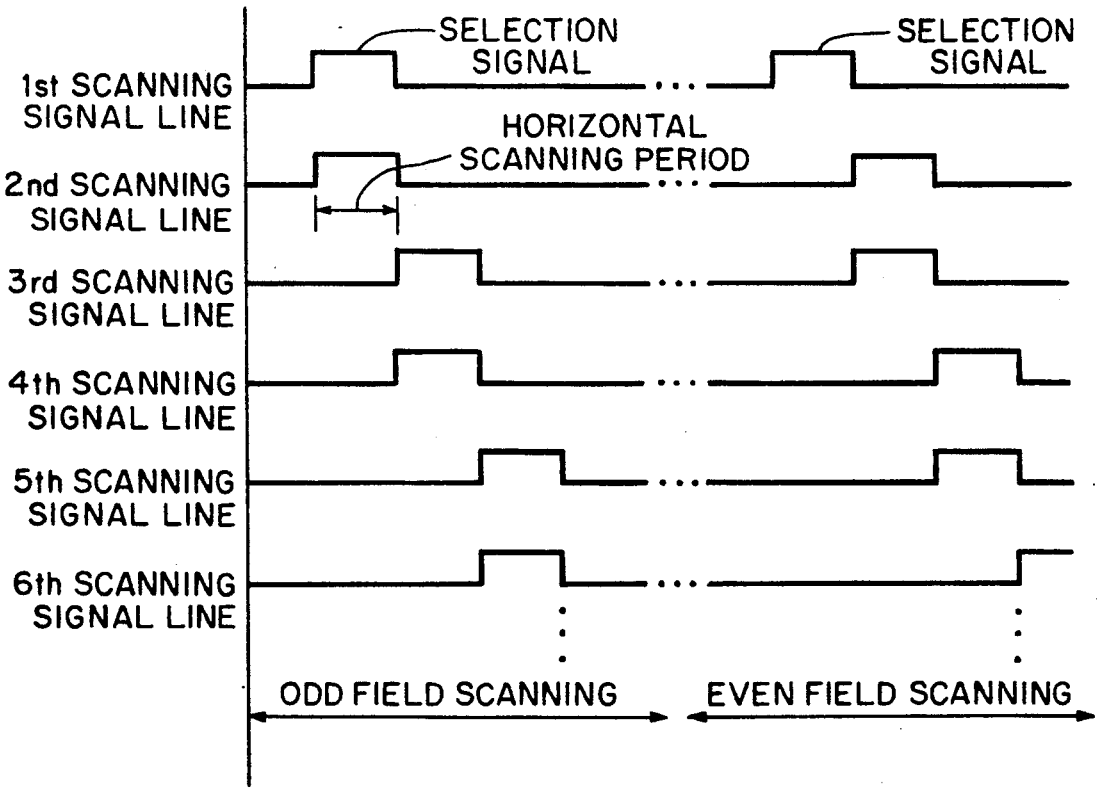
FIG. 14 is a timing chart illustrating the two-line simultaneous scanning method.
Figure 15:
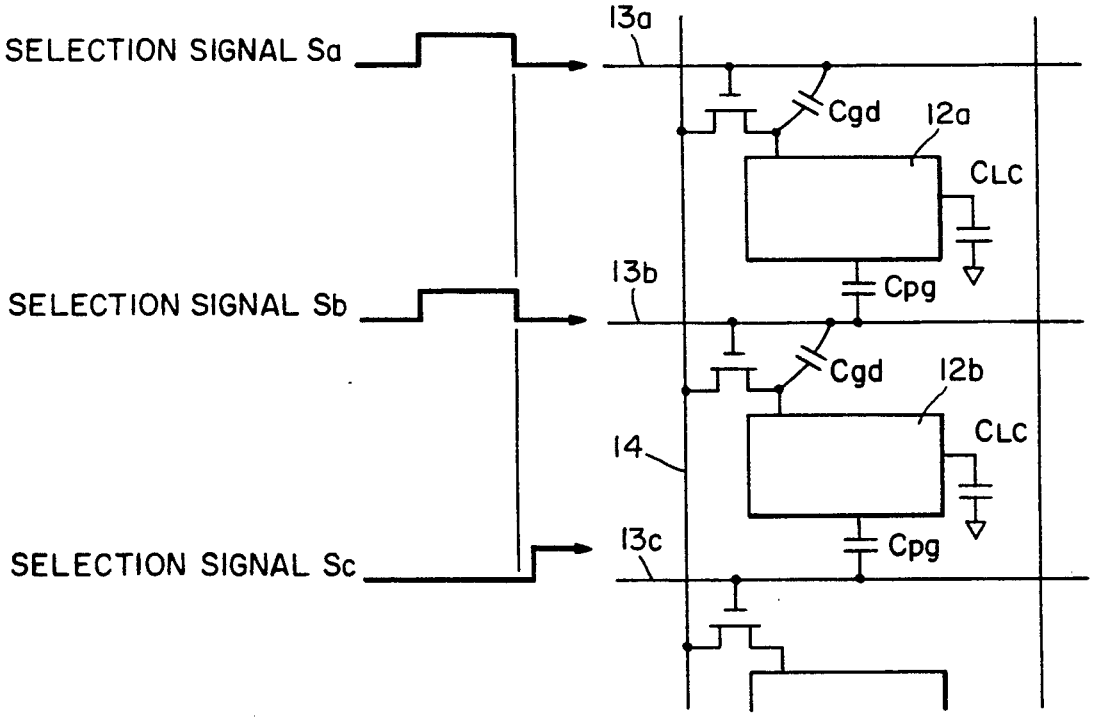
FIG. 15 is a block diagram illustrating the operation of a prior art display apparatus.

It is certified that error appears in the above-identified patent and that said Letters Patent is hereby corrected as shown below:

In the Drawings:

In FIGS. 13, 14 and 15, the words "PRIOR ART" should be placed adjacent the Figure Nos. in each case.

In FIG. 2, the material printed below "FIG. 2" should be deleted.

Signed and Sealed this

Twenty-first Day of June, 1994

Bruce Lehman

*Attest:*

BRUCE LEHMAN

*Attesting Officer*

*Commissioner of Patents and Trademarks*